US011577894B2

(12) United States Patent
Hawkes

(10) Patent No.: US 11,577,894 B2
(45) Date of Patent: Feb. 14, 2023

(54) SELF-BINDING EQUIPMENT TIES

(71) Applicant: Idea Makers, LLC, Salt Lake City, UT (US)

(72) Inventor: Matt Hawkes, Salt Lake City, UT (US)

( * ) Notice: Subject to any disclaimer, the term of this patent is extended or adjusted under 35 U.S.C. 154(b) by 234 days.

(21) Appl. No.: 17/103,349

(22) Filed: Nov. 24, 2020

(65) Prior Publication Data

US 2022/0161978 A1 May 26, 2022

(51) Int. Cl.
*B65D 63/04* (2006.01)

(52) U.S. Cl.
CPC ..... *B65D 63/04* (2013.01); *B65D 2563/00* (2013.01)

(58) Field of Classification Search
CPC ..... B65D 63/04; B65D 2563/00
See application file for complete search history.

(56) References Cited

U.S. PATENT DOCUMENTS 675,308 A * 5/1901 Voss ..... B65D 63/04 24/20 EE
943,607 A * 12/1909 Schelling ..... A43C 1/02 24/715.3
1,263,716 A * 4/1918 Stevens ..... A43C 9/06 24/715.6
1,770,786 A * 7/1930 Kohler ..... A43C 1/02 24/715.3
1,853,666 A * 4/1932 Crimmins ..... D04C 1/06 87/2
2,113,731 A * 4/1938 Kennedy ..... A41F 1/06 24/713.2
2,268,339 A * 12/1941 Leslie ..... B65D 63/04 29/432
2,336,950 A * 12/1943 Moss ..... A42B 1/12 24/712
2,477,151 A * 7/1949 Stapleton ..... A43C 9/00 24/713
2,832,116 A * 4/1958 Clevett, Jr. ..... F16G 11/14 383/76
2,887,005 A * 5/1959 Fromm ..... A43C 1/02 87/2
2,960,365 A * 11/1960 Meisen ..... B66C 1/18 24/122.3
3,079,192 A * 2/1963 Otley ..... D07B 1/185 24/129 B
3,137,863 A * 6/1964 Dimpfl ..... A41D 1/06 2/232
3,426,393 A * 2/1969 Mead ..... B65D 63/10 24/30.5 T
3,475,264 A * 10/1969 Donaldson ..... B65D 63/10 428/114

(Continued)

*Primary Examiner* — Jason W San
(74) *Attorney, Agent, or Firm* — Steven Rinehart

(57) ABSTRACT

A self-binding equipment tie may include a bendable core, a flexible cover surrounding the bendable core, and a cavity that surrounds the bendable core within the cover. The bendable core may retain a shape when bent into the shape. The bendable core may be bendable by hand. The bendable core may be unrestrained within the cavity such that the bendable core is moveable within the cavity along two degrees of freedom. The two degrees of freedom may be perpendicular to a length of the flexible cover. The bendable core may be adjacent to an interior surface of the flexible cover, where the interior surface defines the cavity.

8 Claims, 8 Drawing Sheets

(56) References Cited

U.S. PATENT DOCUMENTS 4,423,539 A * 1/1984 Ivanhoe ..... A43C 1/02 57/259
4,640,178 A * 2/1987 Kurzbock ..... D07B 1/02 87/8
4,666,417 A 5/1987 Hillman
4,694,541 A * 9/1987 Skyba ..... F16G 11/12 24/301
4,757,719 A * 7/1988 Franke ..... D07B 1/145 73/862.56
4,850,629 A * 7/1989 St. Germain ..... D07B 7/165 294/74
4,864,695 A * 9/1989 Gold ..... F16G 11/10 24/713.2
5,054,299 A * 10/1991 Maveety ..... A44C 5/0023 63/11
5,471,684 A * 12/1995 Casale ..... A42B 1/0184 2/10
5,540,154 A * 7/1996 Wilcox ..... C06C 5/00 102/275.1
5,727,833 A * 3/1998 Coe ..... B66C 1/12 73/862.56
6,149,215 A * 11/2000 Balogh ..... B66C 1/18 294/74
6,283,004 B1 * 9/2001 Tseng ..... D07B 5/005 87/9
6,341,550 B1 * 1/2002 White ..... A01K 3/005 87/8
6,540,184 B2 4/2003 Thaxton
6,761,654 B2 * 7/2004 Murphy ..... A63B 41/085 473/596
6,796,008 B1 * 9/2004 Huang ..... A43C 9/00 24/712.1
7,204,468 B2 * 4/2007 Kintzele ..... F16G 11/14 248/102
7,637,549 B2 * 12/2009 Hess ..... D07B 1/18 294/74
7,655,863 B2 * 2/2010 Kossak ..... H01R 4/186 174/84 C
7,827,895 B2 * 11/2010 Wang ..... A63B 21/0552 87/9
8,387,216 B1 * 3/2013 Martinson ..... B29C 48/154 24/30.5 T
8,776,322 B2 * 7/2014 Martinson ..... B29C 48/21 24/30.5 T
8,806,723 B2 * 8/2014 Martinson ..... B65D 63/00 24/3.12
9,074,318 B2 * 7/2015 Chou ..... D07B 1/162
9,174,781 B2 * 11/2015 Case ..... B29C 45/14565
9,226,531 B2 * 1/2016 Keathley ..... A41D 1/02
9,562,321 B2 * 2/2017 Manabe ..... D07B 1/005
9,675,120 B2 * 6/2017 Brady ..... A41D 15/00
9,828,724 B2 * 11/2017 Kindstrand ..... D07B 1/18
9,938,062 B1 * 4/2018 Scarlett ..... B65D 63/109
9,999,915 B2 * 6/2018 Clark ..... B21F 45/16
D825,140 S * 8/2018 Bassett Asam ..... D2/738
10,207,659 B2 * 2/2019 Ohgushi ..... H01B 7/17
10,314,366 B2 * 6/2019 Torres ..... B32B 3/08
10,549,895 B2 2/2020 Case et al.
10,973,282 B2 * 4/2021 Satchell ..... A43C 9/00
11,053,615 B2 * 7/2021 Stewart ..... D04B 21/12
2003/0177612 A1 * 9/2003 Hayes ..... B65D 63/00 24/16 R
2009/0000083 A1 * 1/2009 Richard ..... A45F 5/00 24/302
2010/0310834 A1 * 12/2010 Buselli ..... B65D 63/18 428/189
2011/0308049 A1 * 12/2011 Sun ..... H01F 7/0263 24/306
2012/0144631 A1 * 6/2012 Stanev ..... D04C 1/12 24/712
2013/0061429 A1 * 3/2013 Hede ..... A63B 29/02 24/302
2013/0255045 A1 * 10/2013 Gonzalez ..... A43C 9/00 24/715.3
2014/0212213 A1 * 7/2014 Meyers ..... F16B 7/0433 403/396
2014/0265390 A1 * 9/2014 Yale ..... B66C 1/12 294/74
2015/0020491 A1 * 1/2015 Thelen ..... A01D 46/26 56/329
2015/0199893 A1 * 7/2015 St. Germain ..... G08B 21/18 340/539.1
2015/0361830 A1 * 12/2015 Boudebiza ..... B65D 63/10 24/20 R
2015/0368014 A1 * 12/2015 Doll ..... B65D 63/04 24/27
2016/0009470 A1 * 1/2016 Martinson ..... B65D 63/10 24/27
2016/0095420 A1 * 4/2016 Moreau ..... A45F 5/021 248/317
2016/0115658 A1 * 4/2016 Annan ..... E04C 5/122 14/21
2016/0257258 A1 * 9/2016 Conlon ..... A45F 5/00
2016/0278463 A1 * 9/2016 Stevenson ..... A45D 8/34
2017/0367442 A1 * 12/2017 Tsai ..... A43C 1/02
2018/0022521 A1 * 1/2018 Wintz ..... B65D 63/18 24/27
2019/0170272 A1 * 6/2019 Sims ..... F16L 3/137

* cited by examiner

SELF-BINDING EQUIPMENT TIES

BACKGROUND

Equipment may be bound together. The equipment may include a variety of pieces. The pieces may have different sizes and/or shapes. The pieces may have similar sizes and/or shapes. The equipment may be bound together for a variety of reasons. The equipment may be bound together to be stored. The equipment may be bound together to be transported. As an example, a loose set of PVC pipes may be bound together to be transported from a workshop to a job site. As another example, a loose set of logs may be bound together to be transported to a campsite and used as firewood. The equipment may be tied down during transport to prevent the equipment from falling off the vehicle. For example, a tarp may be used to cover and/or secure the equipment. The tarp may be secured to the vehicle by a tie-down.

BRIEF DESCRIPTION OF THE DRAWINGS

The present description will be understood more fully when viewed in conjunction with the accompanying drawings of various examples of self-binding equipment ties. The description is not meant to limit the self-binding equipment ties to the specific examples. Rather, the specific examples depicted and described are provided for explanation and understanding of self-binding equipment ties. Throughout the description the drawings may be referred to as drawings, figures, and/or FIGs.

DETAILED DESCRIPTION

Figure 1A:
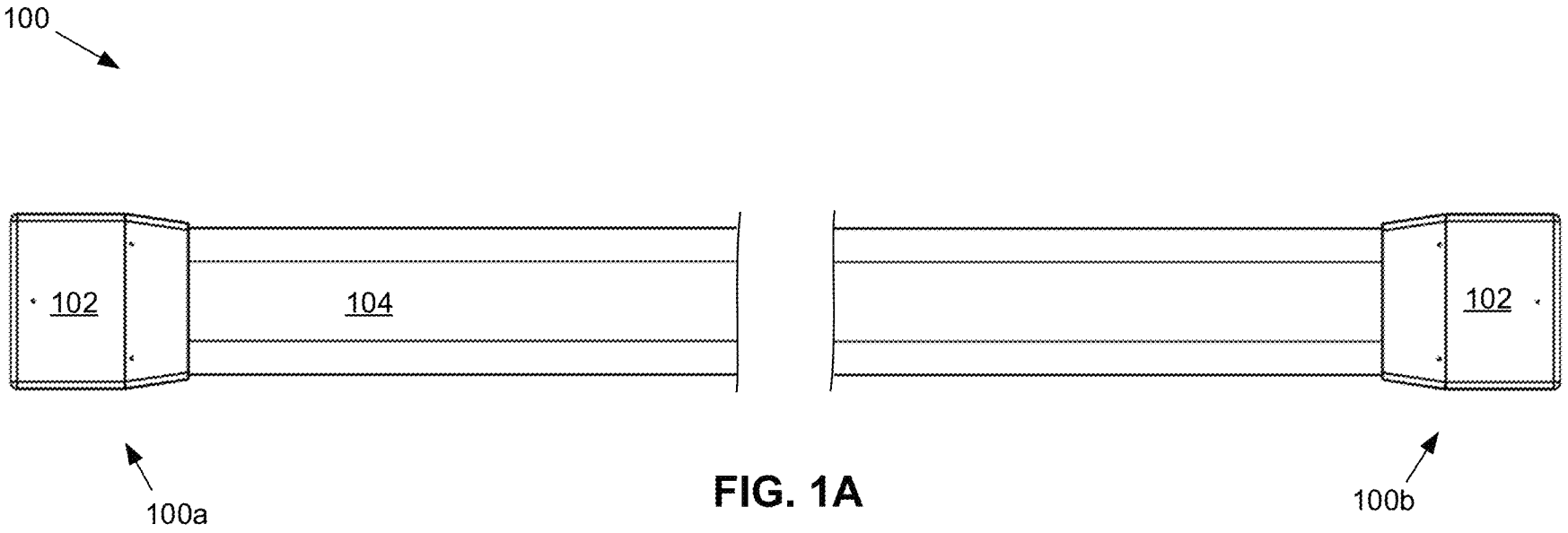
FIG. 1A illustrates a self-binding equipment tie, according to an embodiment.

Self-binding equipment ties as disclosed herein will become better understood through a review of the following detailed description in conjunction with the figures. The detailed description and figures provide merely examples of the various embodiments of self-binding equipment ties. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein.

A conventional tie may include a rope. The rope may be wrapped around a bundle of objects and tied to secure the bundle of objects together. However, when the rope is tied incorrectly, the rope may become loose and allow the bundle to fall apart. Indeed, ropes coming untied from bundles and/or securing loads is common enough that it has become the basis of a well-known joke centered on "dads" over-tying bundles and loads. Additionally, while there are many knots that are sufficient to prevent a rope from coming untied, learning these knots, and correctly tying them is apparently something "dads" have not figured out. Even when the knots are learned and correctly tied, they can be time-consuming to tie and untie.

Another conventional tie may include a strap. Similar to the rope, the strap may be wrapped around the bundle of objects and tied. Additionally, some straps are tightened and secured around the bundle or on a load by a ratcheting mechanism. A ratchet strap system may include a strap with a hook on one end and a ratchet with a hook. The ratchet may be attached to the loose end of the strap. The hooks may be secured, and the ratchet may be tightened. However, ratchet strap systems may be complex and are often incorrectly assembled. This may cause the system to malfunction or be inoperable to begin with. Additionally, it may be time-consuming to correctly use the system.

Another conventional tie may include an elastic cord such as a bungee cord. A bungee cord may include an elastic cord with hooks at each end. A bungee cord may be stretched around a bundle and/or over a load to secure the bundle/load. However, it may be challenging to estimate the correct length of cord for a particular use. When the cord is too long, it will be loose and will not secure the bundle and/or load. When the cord is too short, it will not stretch far enough to be secured. The bungee cord may be dangerous to use, as well. When stretched, the bungee cord store a significant amount of potential energy. When the bungee cord is released, the potential energy may cause the bungee cord to snap. This may cause injury to a person and/or property.

Implementations of self-binding equipment ties may address some or all of the problems described above. A self-binding equipment tie may include a bendable core, a flexible cover surrounding the bendable core, and a cavity that surrounds the bendable core within the cover. The bendable core may retain a shape when bent into the shape. The bendable core may be bendable by hand. The bendable core may be unrestrained within the cavity such that the bendable core is moveable within the cavity along two degrees of freedom. The two degrees of freedom may be perpendicular to a length of the flexible cover. The bendable core may be adjacent to an interior surface of the flexible cover, where the interior surface defines the cavity.

The self-binding equipment ties may be simple to use, durable, and instill confidence that a bundle and/or load is sufficiently secured. A self-binding tie may be wrapped around a bundle. The two ends of the tie may be twisted together. Twisting the two ends of the tie together may cause the tie to bind to itself. The tie may be coated with a rubberized coating that may increase the friction of the exterior surface of the tie. When twisted together, the tie may resist pulling apart. The ends of the tie may be twisted around other objects to secure the tie to the objects. An end of the tie may be twisted together with a midsection of the tie. Because the tie can be twisted together in a variety of ways, the length of the tie is not a factor provided the tie is long enough to surround the bundle or reach a securing member to tie down a load. Additionally, the tie does not store potential energy, thus minimizing and/or eliminating the risks associated with elastic cords.

FIG. 1A illustrates a self-binding equipment tie 100, according to an embodiment. The self-binding equipment tie 100 (i.e. the equipment tie 100) may be flexible enough to bend by hand and rigid enough to retain shape when bent into a shape. The equipment tie 100 may have a variety of lengths to accommodate a variety of uses. The equipment tie 100 may prevent unwinding when it is twisted on itself or another object, thus remaining secure when various forces are exerted on the tie that may otherwise cause it to come undone. The equipment tie 100 may avoid knotting, which may make the equipment tie 100 easier to work with and/or store. The equipment tie 100 may have a high tensile strength, making it suitable for securing large and/or heavy loads. The equipment tie 100 may be durable, having a long service life. The equipment tie 100 may be used in a variety of weather conditions outdoors and may resist deteriorating in harsh weather conditions.

The equipment tie 100 may include an end cap 102. The end cap 102 may be disposed at opposing ends of the equipment tie 100, e.g. at a first end 100*a* and a second end 100*b*. A cover 104 may extend between the end caps 102. The cover 104 may extend from the first end 100*a* of the equipment tie 100 to the second end 100*b* of the equipment tie 100. A rigid-flex, bendable core may be disposed within the cover 104. The core may extend from the first end 100*a* of the equipment tie 100 to the second end 100*b* of the equipment tie 100. The end caps 102 may be clamped onto the core and/or the cover 104 at a first end of the cover 104 (e.g. the cover 104 at the first end 100*a*) and/or at a second end of the cover (e.g. the cover 104 at the second end 100*b*). The end caps 102 may prevent length-wise movement of the core relative to the cover 104, e.g. sliding of the core towards and/or away from the first end 100*a* and the second end 100*b*.

The equipment tie 100 may be manufactured in a variety of sizes. The equipment tie 100 may have a width in a range from half an inch to three inches. The equipment tie 100 may have a width of one inch, one-and-a-half inches, two inches, and/or two-and-a-half inches. The width of the equipment tie 100 may vary along a length of the equipment tie 100. The width of the equipment tie 100 may be uniform along the length of the equipment tie 100. The length of the equipment tie 100 may be in a range from six inches to twenty feet. The length of the equipment tie 100 may be in a range from six inches to ten feet. The length of the equipment tie 100 may be three feet, six feet, or ten feet. The width of the equipment tie 100 may correspond to the length of the equipment tie. For example, the equipment tie 100 may be six inches long and half an inch wide. As another example, the equipment tie 100 may be six feet long and one inch wide. As yet another example, the equipment tie 100 may be twenty feet long and four inches wide.

The length of the equipment tie 100 may be the length from end-to-end, including the end caps 102. The length of the equipment tie 100 may be the length excluding the end caps 102. The width of the equipment tie 100 may refer to the width of the cover 104 from side-to-side. The width of the cover 104 may be independent of the width of the core, i.e. equipment ties 100 having different widths may have cores with the same diameter.

Figure 1B:
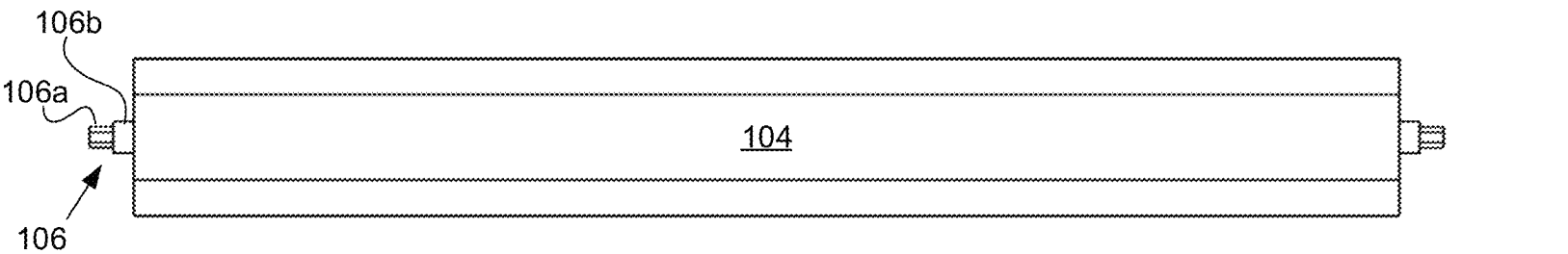
FIG. 1B illustrates a segment of the equipment tie with a core of the equipment tie revealed, according to an embodiment.

FIG. 1B illustrates a segment of the equipment tie 100 with the core 106 of the equipment tie 100 revealed, according to an embodiment. The core may define an overall shape of the equipment tie 100. The core may be rigid enough to retain a shape under its own weight and against some additional force. The core may be flexible enough to be bent into a different shape by hand without fracturing or otherwise breaking. The rigid-flex core may be flexible enough to be bent by hand, e.g. a user of average strength and dexterity may be capable of bending the equipment tie 100 into a variety of shapes with a nominal amount of exertion. The core 106 may be flexible enough to be bent by hand from a first shape to a second shape, e.g. wrapped around a bundle of objects and twisted together by hand. The core 106 may be rigid enough to retain the second shape when the bending force is released, e.g. the core 106 will remain twisted together when released.

The core 106 may include one or more wires 106*a*. The wires 106*a* may be made of a bendable material. The wires 106*a* may be metallic strands of material. For example, the wires 106*a* may be made of nickel, copper, steel, aluminum, combinations thereof, and so forth. The wires 106*a* may be encased in a sheath 106*b*. The sheath 106*b* may be made of a plastic and/or rubberized polymer. The sheath 106*b* may encase the wires 106*a* such that the sheath 106*b* is directly adjacent to and forms contact with a surface of the wires 106*a*. The sheath 106*b* may be between the wires 106*a* and an inner surface of the cover 104. The sheath 106*b* may be adjacent to the inner surface of the cover 104.

The wires 106*a* may be intertwined with each other or independent of each other. The wires 106*a* may be twisted together. The wires 106*a* may be positioned adjacent to each other without being twisted or otherwise intertwined. The wires 106*a* may be bound together by the sheath 106*b*. The wires 106*a* may be individually sheathed.

Figure 2:
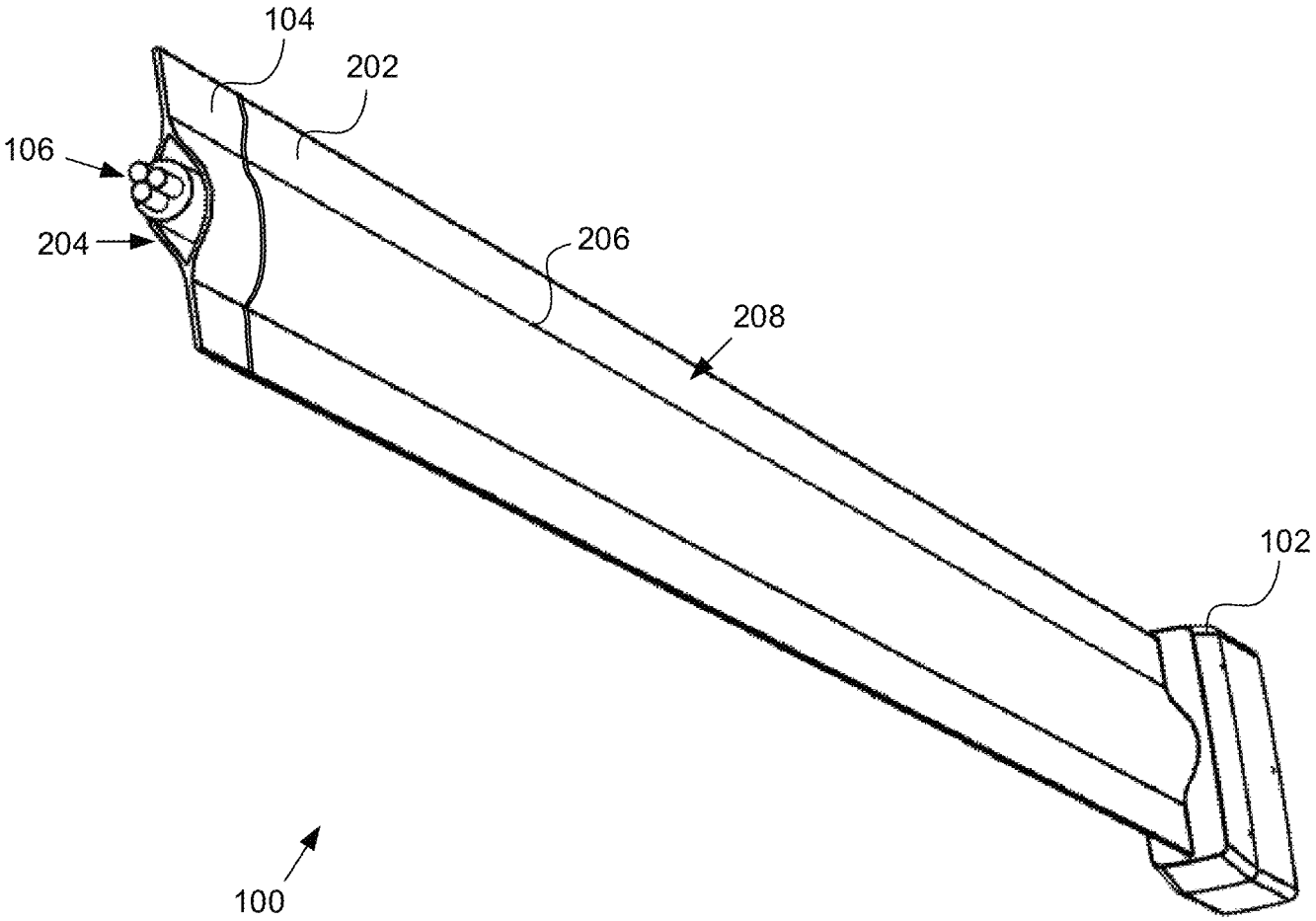
FIG. 2 illustrates the equipment tie with a friction coating, according to an embodiment.

FIG. 2 illustrates the equipment tie 100 with a friction coating 202, according to an embodiment. The friction coating 202 may increase the ability of the equipment tie 100 to bind to itself and other objects. The friction coating 202 may prevent the equipment tie 100 from untwisting from itself when the equipment tie 100 is used to secure a bundle and/or load. The friction coating 202 may prevent the equipment tie from sliding and/or shifting on the bundle and/or load. This may reduce a risk that the bundle and/or load becomes loose, such as when the bundle and/or load is transported. This may also make it easier to tie the bundle and/or load because the equipment tie 100 will not slip around as it is being used to secure the bundle and/or load.

The end caps 102 and the cover 104 may surround the core 106 such that the core 106 is enclosed inside the equipment tie 100. The cover 104 may be flexible. The cover 104 may be flexible enough to flex under its own weight without the support of the core 106. The cover 104 may be made of a textile material. The cover 104 may be made of a woven textile. The cover 104 may be made of a fabric material. The cover 104 may be made of woven and/or webbed strands of cotton, polyester, nylon, spandex, combinations thereof, and so forth. The cover 104 may have a thickness in a range from half a millimeter to three millimeters.

The cover 104 may form a cavity 204. The cavity may extend along a length of the cover 104 from a first end of the cover 104 to a second end of the cover (e.g. from the first end 100*a* to the second end 100*b* of the equipment tie 100). The cover 104 may be closed at the first end 100*a* and the second end 100*b* of the equipment tie, enclosing the cavity 204 within the cover 104. The core 106 may be positioned in the cavity 204.

The cavity 204 may be over-sized relative to the core 106. For example, the cavity 204 may have a greater volume than a volume occupied by the core 106. The volume of the cavity 204 may be greater than the volume of the core 106 by an amount in a range from twenty percent greater to three hundred percent greater. This may allow the cover 104 to twist around the core 106, collapse around the core 106, and/or otherwise deform around the core 106. When the cover 104 deforms around the core 106, it may conform to an object it is against, thereby increasing a surface area of contact with the object. When the surface area of contact is increased, an amount of friction between the cover 104 and the object is increased. This makes the equipment tie 100 more secure when binding and/or tying down objects.

The core 106 may be unrestrained within the cavity 204 such that the core 106 is moveable within the cavity 204 with two degrees of freedom while being secured relative to the cover along the length of the cover 104 and/or the length of the equipment tie 100. The cap may secure the cover 104 and the core 106 together to prevent movement along the length of the cover 104 and/or the length of the equipment tie 100. For example, the cap may be clamped onto the cover 104 and the core 106 or pressure-molded onto the cover 104 and the core 106. The two degrees of freedom along which the core is unrestrained may be perpendicular to the length of the cover 104 and/or the equipment tie 100. The core 106 may be adjacent to an interior surface of the cover 104. The interior surface of the cover 104 may define the cavity 204.

The cavity 204 may be formed by stitching 206 in the cover 104. The stitching 206 may extend along the length of the cover 104 from the first end of the cover 104 to the second end of the cover 104 (e.g. from the first end 100*a* to the second end 100*b* of the equipment tie 100). The stitching 206 may be made with the same material as the cover 104 or a different material. The stitching 206 may include a straight stitch, a chain stitch, a zigzag stitch, a running stitch, a lock stitch, and so forth.

The stitching 206 may form a border between the cavity 204 and a flap 208 opposite the stitching 206 from the cavity 204. The flap 208 may be a portion of the cover 104 outside the stitching 206. The flap 208 may extend along the length of the cover 104 from the first end of the cover 104 to the second end of the cover 104. The flap 208 may have a width that is in a range from approximately one-fifth the width of the cover 104 to approximately three-eighths the width of the cover 104. The flap 208 may have a width that is approximately one-third the width of the cover 104. In one example, the cover 104 may have a width of approximately one inch, and the flap 208 may account for five-sixteenths of the width of the cover 104.

The friction coating 202 may have a greater coefficient of friction than the material that forms the cover 104. The friction coating 202 may thereby be configured to resist slippage of the cover 104 against itself as different sections of the cover 104 are bound against each other. The friction coating 202 may be configured to resist slippage of the cover 104 against another object as the cover 104 is pressed against the object. The friction coating 202 may be made of rubber and/or a rubberized polymer. The friction coating 202 may be made of a thermoplastic polyurethane (TPU). The friction coating 202 may be made of a flexible polymer-based resin impregnated with a gritty substance such as irregular-shaped silica.

The friction coating 202 may be sprayed onto the cover 104 to coat an exterior surface of the cover 104. The friction coating 202 may coat the entire exterior surface of the cover 104. The friction coating 202 may coat a portion of the cover 104 while another portion of the cover 104 remains exposed. For example, the cover 104 may be striped with the friction coating 202. The striping may be segmented along the length of the cover 104. The striping may be diagonal along the length of the cover 104. The friction coating 202 may coat the cover 104 along the flap 208 while the portion of the cover 104 over the cavity 204 is uncoated. The friction coating 202 may coat the portion of the cover 104 over the cavity 204 while the flap 208 is uncoated. Coating some portions of the cover 104 while leaving other portions uncoated may increase the coefficient of friction of the cover while using less material, reducing the cost of manufacturing the equipment tie 100.

Figure 3A:
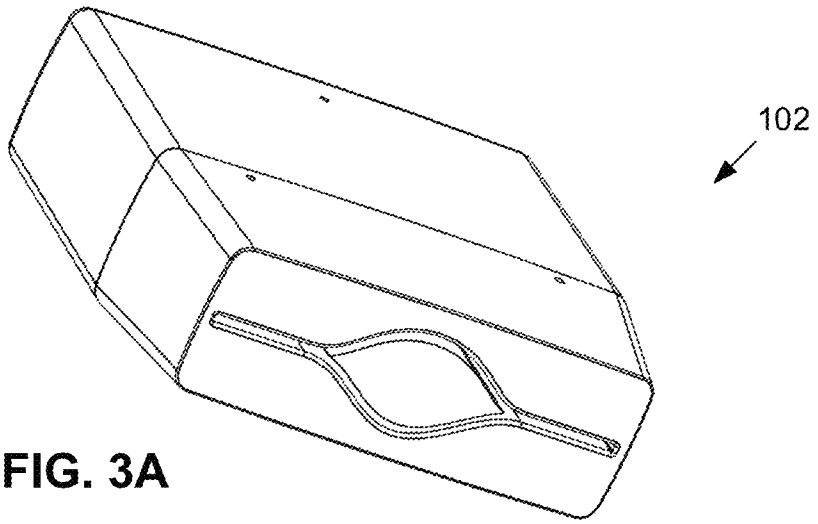
FIG. 3A illustrates an end cap of the equipment tie, according to an embodiment.

FIG. 3A illustrates the end cap 102, according to an embodiment. The end cap 102 close off and/or secure the ends of the equipment tie 100. The end cap 102 may serve as a catch to further prevent the equipment tie 100 from loosening and/or untwisting. The end cap 102 may bind the cover 104 and the core 106 together. The end cap 102 may prevent the core 106 from tearing through the cover 104.

The end cap 102 may be made of a plastic polymer. The end cap 102 may be made of a thermoplastic material. The end cap 102 may be molded and/or extruded. The end cap may be made of a metal material such as steel. The end cap 102 may be cast in a die. The end cap 102 may secure the core 106 and the cover 104 together by frictional engagement with the core 106 and/or the cover 104. The end cap 102 may be clamped on to the cover 104 and/or the core 106 with sufficient pressure to prevent the end cap 102 from coming loose from the cover 104 and/or the core 106. The core 106 and/or the cover 104 may be bonded to an interior surface of the end cap 102, such as by an adhesive. The end cap 102 may be metallic and the core 106 may be metallic. The core 106 may be welded to the interior of the end cap 102. The end cap 102 may be plastic and may be pressure molded onto the cover 104 and/or the core 106. The molding process may cause the end cap 102 to bond to the cover 104 and/or the core 106.

Figure 3B:
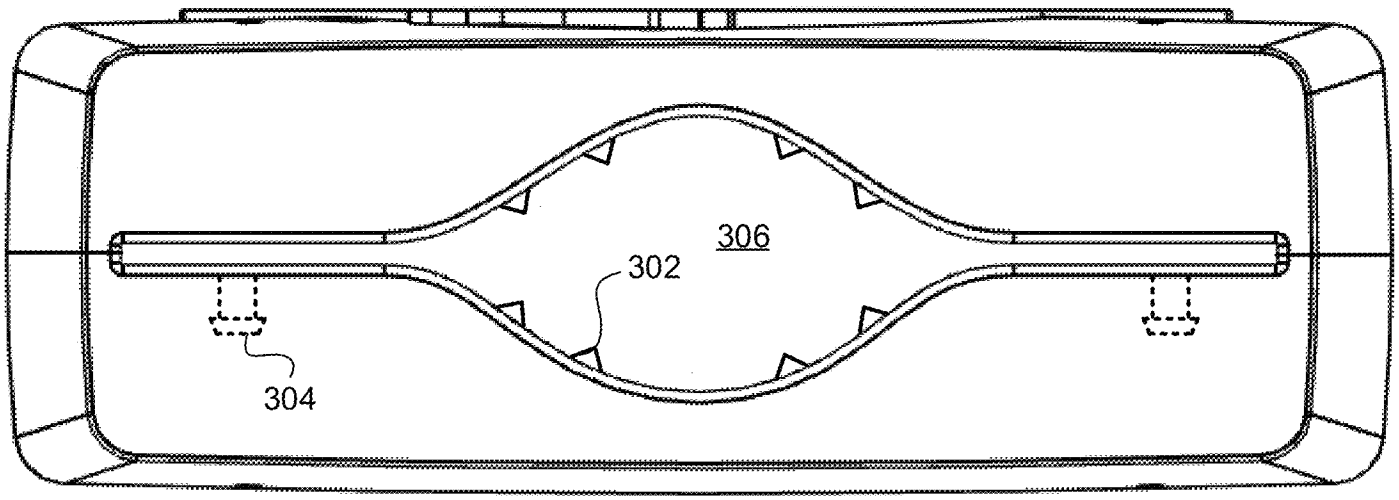
FIG. 3B illustrates the end cap with teeth 302 and clips, according to an embodiment.

FIG. 3B illustrates the end cap 102 with teeth 302 and clips 304, according to an embodiment. The teeth 302 may face inward into a cavity 306 of the end cap 102. The cover 104 and the core 106 may be positioned in the cavity 306. The teeth 302 may bite into the cover 104 and/or the core 106 to retain the components within the end cap 102. The clips 304 may secure two sides of the end cap 102 together to keep the teeth engaged with the cover 104 and/or the core 106. The end cap 102 may include two clips 304, three clips 304, four clips 304, and so forth.

The end cap 102 may have a greater width than the width of the cover 104 when the core 106 is positioned in the cavity 204 of the cover 104. The end cap may have a smaller width than the cover 104. The cover 104 may include two instances of the flap 208 on opposing sides of the cavity 204 of the cover 104. The flaps 208 may extend wider than the width of the end cap 102. The end cap 102 may enclose the portion of the cover 104 that forms the cavity 204 of the cover 104. The end cap 102 may have a length in a range from half an inch to three inches. The cavity 306 of the end cap 102 may extend a portion of the length of the end cap 102. The cavity 306 of the end cap 102 may extend a substantial portion of the length of the end cap 102. The cavity 306 of the end cap 102 may have a depth in a range from one-quarter of an inch to two-and-three-quarters of an inch.

Figure 4:
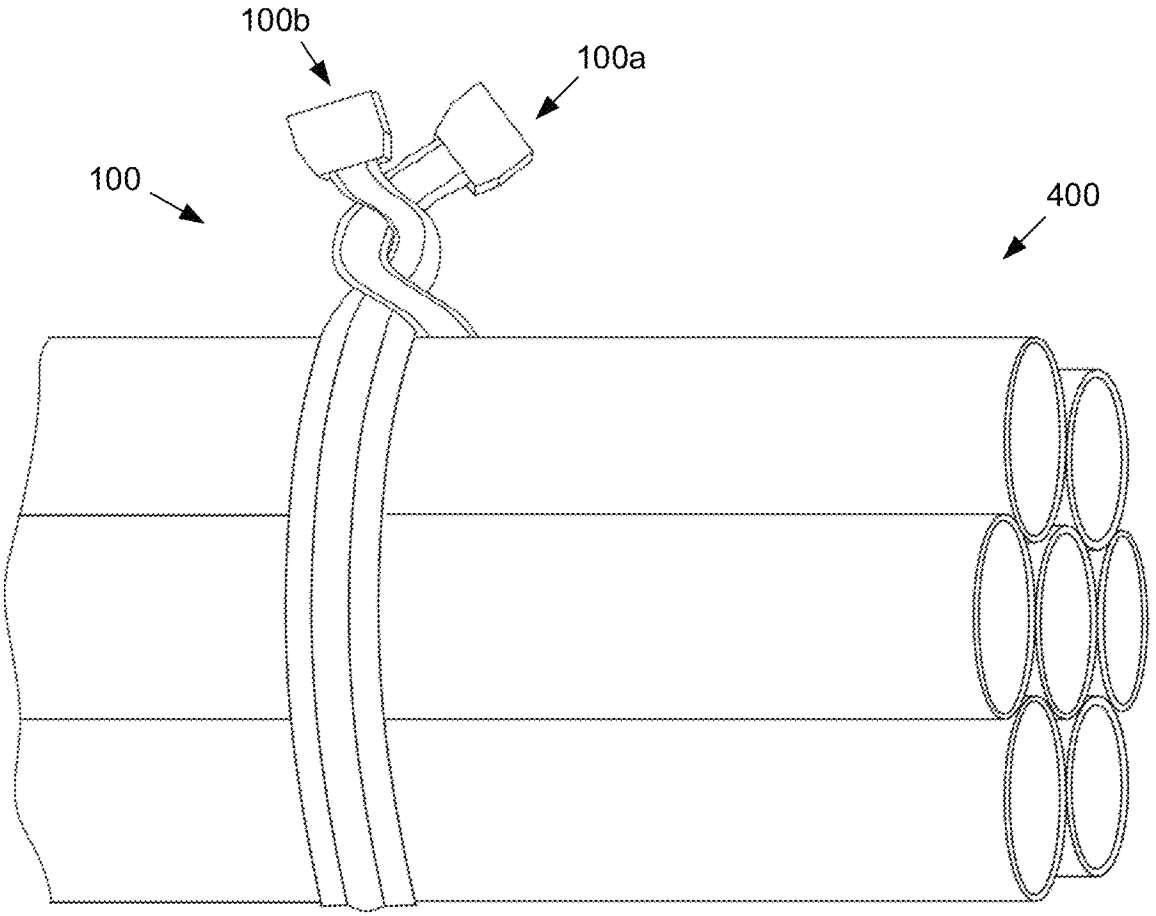
FIG. 4 illustrates the equipment tie wrapped around a bundle of pipe, according to an embodiment.

FIG. 4 illustrates the equipment tie 100 wrapped around a bundle of pipe 400, according to an embodiment. The equipment tie 100 may be wrapped around a bundle of objects such as the bundle of pipe 400. The friction coating 202 may prevent slippage of the equipment tie 100 on the bundle of objects.

The equipment tie 100 may be twisted around itself, such as by twisting the first end 100*a* and the second end 100*b* of the equipment tie 100 around each other. The friction coating 202 may cause the first end 100*a* and the second end 100*b* to bind together, preventing them from coming untwisted. The core 106 may cause the equipment tie 100 to retain the twisted shape. The cover 104 may deform, which may increase the binding of the equipment tie 100 together. The core 106 may be sturdy enough to support a significant amount of weight, such as up to 50 lbs, up to 100 lbs, up to 200 lbs, and so forth. The amount of weight the equipment tie 100 may support may correspond to a diameter and/or a material of the core 106. The amount of weight supportable by the equipment tie 100 may be independent of the material used for the cover 104 and/or the friction coating 202.

Figure 5B:
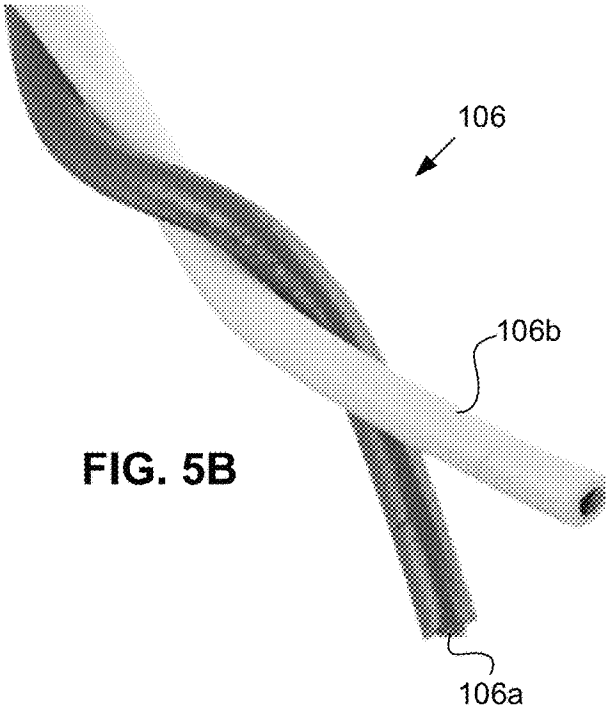
FIG. 5B illustrates the core with two wires, according to an embodiment.
Figure 5D:
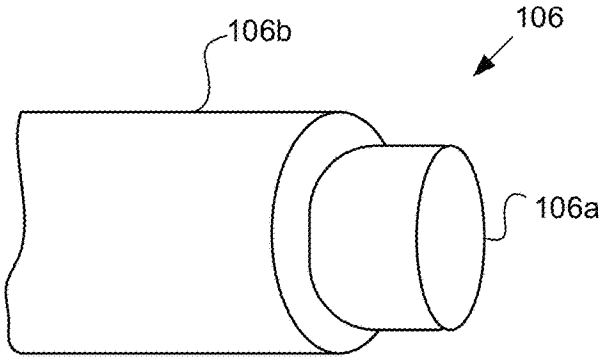
FIG. 5D illustrates the core with a single wire, according to an embodiment.
Figure 5A:
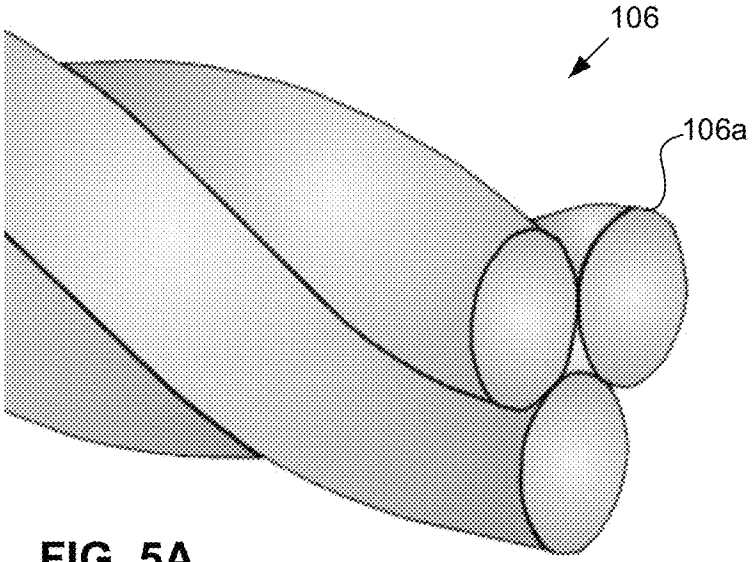
FIG. 5A illustrates the core of the equipment tie with three wires, according to an embodiment.

FIG. 5A illustrates the core 106 with three wires 106*a*, according to an embodiment. The wires 106*a* may be twisted together. Twisting the wires 106*a* of the core 106 may prevent the wires 106*a* from slipping against each other and/or from coming apart. The wires 106*a* may be twisted when the core 106 includes the sheath 106*b*. The sheath may further bind the twisted wires 106*a* together. The wires 106*a* may be individually sheathed. Twisting the wires 106*a* when they are individually sheathed may keep the core 106 together as a single unit. The wires 106*a* may not be sheathed and may be bare within the cavity 204 of the cover 104. The core 106 may include three or more wires 106*a* twisted together or otherwise intertwined.

FIG. 5B illustrates the core 106 with two wires 106*a*, according to an embodiment. The wires 106*a* may be twisted together. Each wire 106*a* may be separately sheathed with the sheath 106*b*. Separately sheathing the wires 106*a* may prevent wear of the wires against each other. The sheath 106*b* may further prevent wearing of the cover 104 against the wires 106*a*.

Figure 5C:
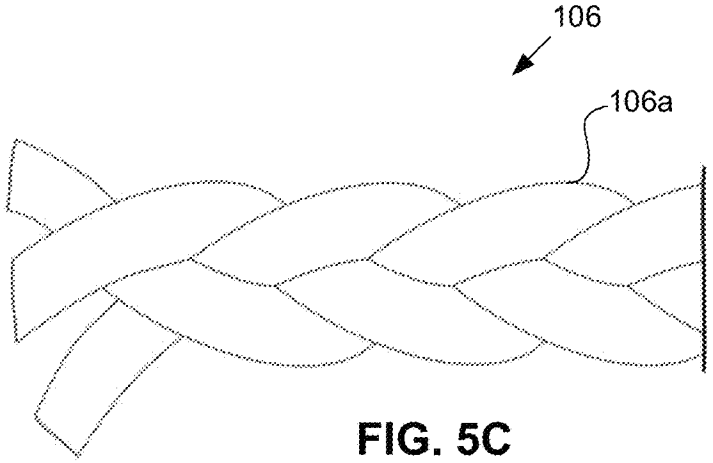
FIG. 5C illustrates the core with three wires braided together, according to an embodiment.

FIG. 5C illustrates the core 106 with three wires 106*a* braided together, according to an embodiment. The core 106 may include three or more wires 106*a*. The wires 106*a* may be braided and/or otherwise intertwined. Braiding the wires 106*a* together may increase a strength of the core 106. Braiding the wires 106*a* may prevent the wires 106*a* from separating in the cavity 204 of the cover 104.

FIG. 5D illustrates the core 106 with a single wire 106*a*, according to an embodiment. The wire 106*a* may be encased in the sheath 106*b*. The wire 106*a* may be unsheathed and may be bare in the cavity 204 of the cover 104. An individual wire 106*a* of the core 106 (whether the core includes one or more wires 106*a*) may have a diameter in a range from one millimeter to three millimeters, from one millimeter to five millimeters, from two millimeters to four millimeters, and so forth. The wire 106*a* may be a twelve-gauge single-stranded wire, a ten-gauge single-stranded wire, an eight-gauge single-stranded wire, a six-gauge single-stranded wire, and/or a four-gauge single-stranded wire.

Figure 6:
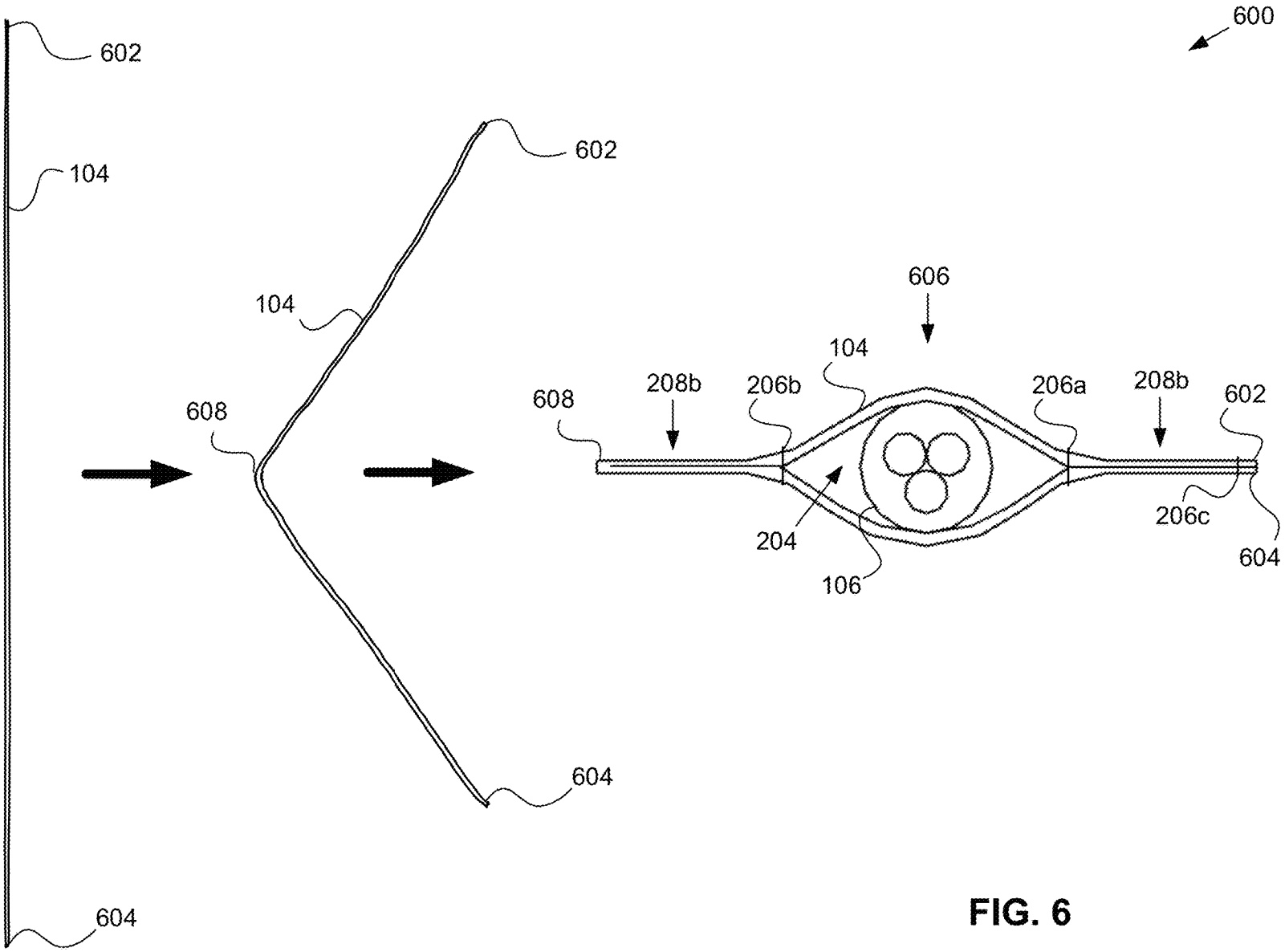
FIG. 6 illustrates a process of forming the cover of the equipment tie from a single sheet of material, according to an embodiment.

FIG. 6 illustrates a process 600 of forming the cover 104 of the equipment tie 100 from a single sheet of material, according to an embodiment. Using a single sheet of material for the cover may simplify the manufacturing process. Using a single sheet of material for the cover may provide at least one side of the cover 104 with a durable edge that will resist fraying without extra binding and/or protection for the edge. This may further reduce the cost and/or time of manufacturing the equipment tie 100.

The cover 104 material may have a width that is approximately twice the width of the cover when the equipment tie 100 is assembled. The width of the cover 104 material may span between a first edge 602 of the cover 104 material and a second edge 604 of the cover 104 material. The first edge 602 and the second edge 604 may span the length of the cover 104. The cover 104 material may be folded in half length-wise. The first edge 602 and the second edge 604 may be brought together. A region 606 of the cover 104, when folded, may be designated to be the cavity 204 of the cover 104. The stitching 206 may be made on opposite sides of the region 606 designated to be the cavity 204. The stitching 206 may run the length of the cover 104 to form the cavity 204 and the flaps 208.

The cover 104 may include a first flap 208*a* and a second flap 208*b*. The first flap 208*a* may be formed between first stitching 206*a* and the first and second edges 602, 604 of the single sheet of the cover 104 material. The second flap 208*b* may be formed between second stitching 206*b* and the fold 608 in the single sheet of the cover 104 material. Third stitching 206*c* may join the first edge 602 and the second edge 604 of the cover 104 material together.

Figure 7:
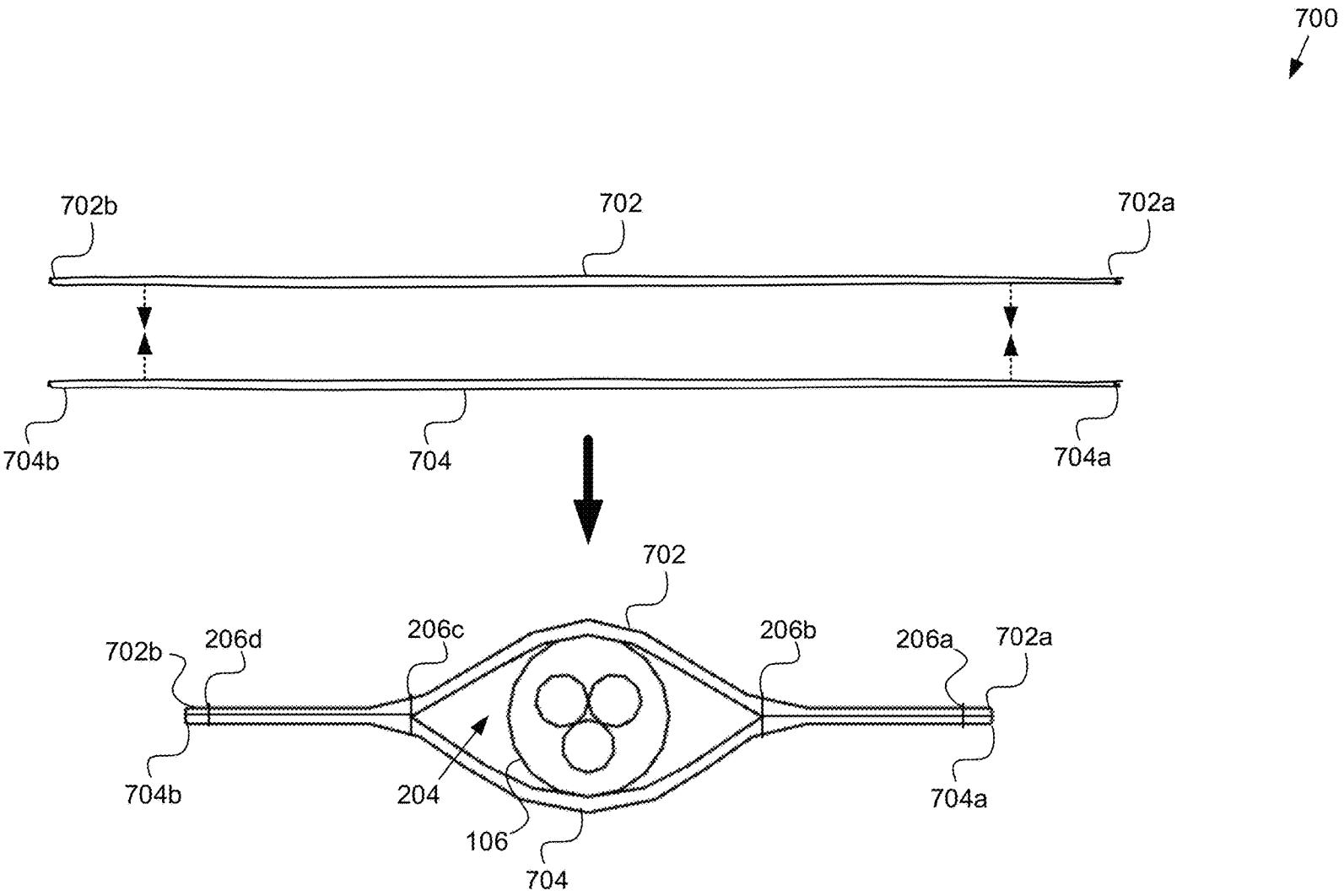
FIG. 7 illustrates a process of forming the equipment tie from two sheets of material, according to an embodiment.

FIG. 7 illustrates a process of 700 forming the equipment tie 100 from two sheets of the cover 104 material, according to an embodiment. In some automated manufacturing settings, it may be simpler and/or more cost-effective to stitch together two separate sheets of material together. For example, several of the cover 104 may be formed from two sheets of material. The two sheets may be stitched together with several lines of stitching that form the segments of multiple instances of the cover 104. The sheets may be cut between instances of the cover 104 to separate the covers 104 from each other. This may be done quickly by a machine that feeds the sheets of material through an automated assembly line to stitch and then cut the sheets.

The cover 104 may include a top sheet 702 and a bottom sheet. The top sheet 702 may have a first edge 702*a* and a second edge 702*b*. The bottom sheet 704 may have a first edge 704*a* and a second edge 704*b*. The top sheet 702 and the bottom sheet may have the same length and width. The top sheet 702 may have a greater width than the bottom sheet 704, or the bottom sheet 704 may have a greater width than the top sheet 702. The edges of the top sheet 702 and the bottom sheet 704 may be aligned or offset. When the edges of the top sheet 702 and the bottom sheet 704 are offset, the longer side may be folded over the shorter side to seal the edges of the cover 104.

The first edge 702*a* of the top sheet 702 may be stitched together with the first edge 704*a* of the bottom sheet 704 by the first stitching 206*a*. The top sheet 702 may be stitched together with the bottom sheet by the second stitching 206*b*. The top sheet 702 and the bottom sheet 704 may form a joined strip between the first stitching 206*a* and the second stitching 206*b*. The joined strip may form the first flap 208*a*. The top sheet 702 and the bottom sheet 704 may be stitched together by the third stitching 206*c*. The second stitching 206*a* and the third stitching 206*b* may define the region 606 of the cover 104 that forms the cavity 204. The second edge 702*b* of the top sheet 702 may be stitched together with the second edge 704*b* of the bottom sheet 704 by fourth stitching 206*d*. The top sheet 702 and the bottom sheet 704 may form a second joined strip between the third stitching 206*c* and the fourth stitching 206*d*. The second joined strip may form the second flap 208*b*.

The cavity 204 of the cover 104 may be formed between the top sheet 702 and the bottom sheet 704. Boundaries of the cavity 204 may be defined by the top sheet 702, the bottom sheet 704, the second stitching 206*b*, and the third stitching 206*c*. The top sheet 702 may define a top of the cavity 204. The bottom sheet 704 may define a bottom of the cavity 204. The second stitching 206*b* may define a first side of the cavity 204. The third stitching 206*c* may defined a second side of the cavity 204. The core 106 may be positioned in the cavity adjacent to the top sheet 702 and the bottom sheet 704. The cavity 204 may have a volume that is greater than a volume occupied by the core 106 such that there is space between the core 106 and the top and bottom sheets 702, 704 along at least some portions of the circumference of the core 106. The first flap 208*a* may be on a first side of the cavity 204. The second flap 208*b* may be on a second side of the cavity 204 opposite the first side of the cavity 204.

The first edge 702*a* of the top sheet 702 and the first edge 704*a* of the bottom sheet 704 may be unjoined (i.e. loose from each other) such that the first flap 208*a* may include a top strip and a bottom strip that are separate from each other. Similarly, the second edges 702*b*, 704*b* of the top sheet 702 and the bottom sheet 704 may be loose from each other. The top sheet 702 may be stitched together with the bottom sheet 704 by the second stitching 206*b* and the third stitching 206*c* and the first stitching 206*a* and the fourth stitching 206*d* may be omitted. The second flap 208*b* may include a top strip and a bottom strip that are separate from each other.

Figure 8:
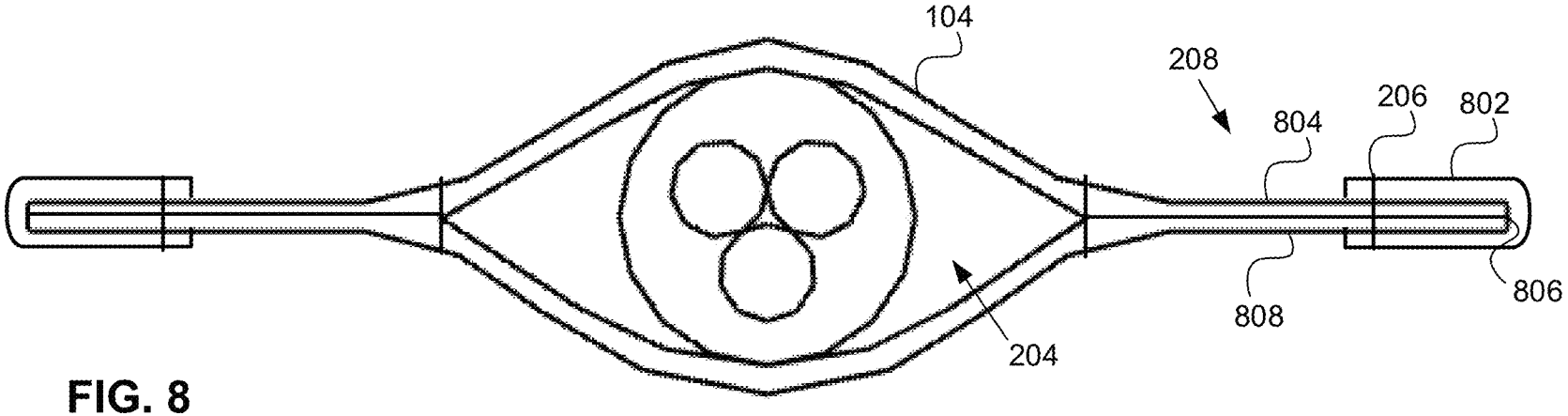
FIG. 8 illustrates the equipment tie with caps around flaps of the cover, according to an embodiment.

FIG. 8 illustrates the equipment tie 100 with caps 802 around the flaps 208 of the cover 104, according to an embodiment. The equipment tie 100 may be put to rugged use which may cause fraying of the cover 104 material at the edges of the cover 104 (e.g. the first edge 702*a*, the second edge 702*b*, and so forth). The caps 802 may protect the edges of the cover 104 from wear and/or may prevent fraying of the edges. This may extend the service life of the equipment tie 100.

The cap 802 may extend from a top surface 804 of the cover 104, away from the cavity 204, and around an edge 806 of the cover 104 to a bottom surface 808 of the cover 104. The cap 802 may cover at least a portion of the flap 208. The cap 802 may reinforce the flap 208. The cap 802 may be made of the same material as the cover 104. For example, the cap 802 may be made of a textile material with similar flexibility to the cover 104. The cap 802 may be made of a lighter and/or thinner material than the cover 104. The cap 802 may be made of a thinner and more rigid material than the cover 104. The cap 802 may, for example, be made of plastic and/or rubber. The cap 802 may be coated with the friction coating 202.

The cap 802 may be stitched to the cover 104 by the stitching 206. The cap 802 may be stitched to the cover 104 by the stitching 206 at the edge of the flap 208 (e.g. the first stitching 206*a* and/or the fourth stitching 206*d*. The cap 802 may be stitched to the cover 104 by the stitching 206 that defines the cavity 204 of the cover 104 (e.g. the second stitching 206*b* and/or the third stitching 206*c*). The cap 802 may be stitched to the cover 104 by separate stitching 206. The cap 802 may be attached to the cover 104 by other means, such as by an adhesive. The cap 802 may run along the length of the cover 104 from the first end of the cover 104 to the second end of the cover 104. The cap 802 may be attached around the one flap 208 or both flaps 208.

Figure 9:
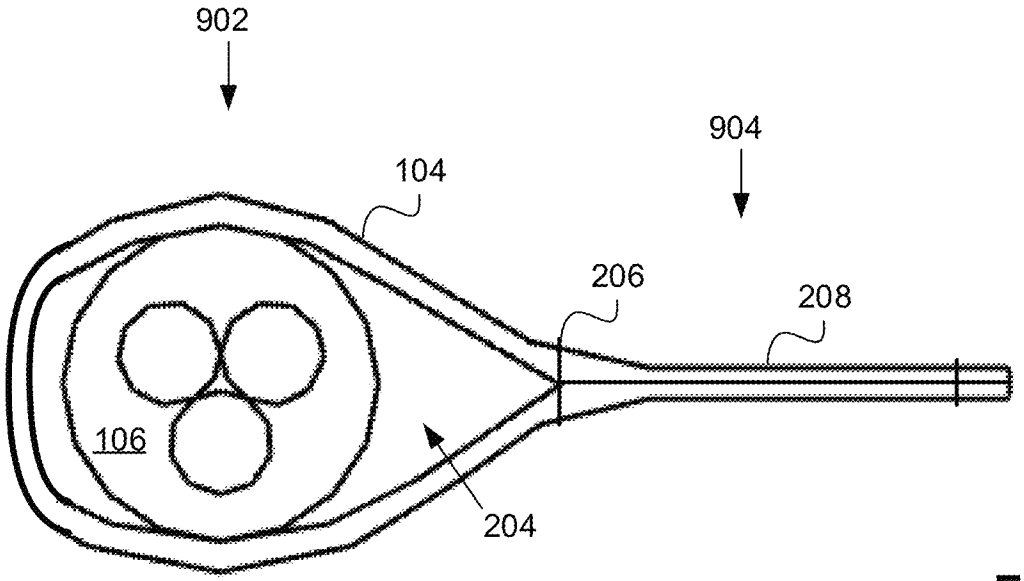
FIG. 9 illustrates the equipment tie with a single flap, according to an embodiment.

FIG. 9 illustrates the equipment tie 100 with a single flap 208, according to an embodiment. In some manufacturing processes, it may be simpler and/or more cost-effective to have one flap 208. Having one flap 208 may reduce the amount of the stitching 206 used to assemble the equipment tie 100. Having one flap 208 may reduce the number of steps to assemble the equipment tie 100.

The cover 104 may include a first side 902 and a second side 904. The first side 902 of the cover 104 may form the cavity 204. The second side 904 of the cover 104 may form the flap 208. The cover 104 may be formed by a single strip of material wrapped around the core 106 and stitched together by the stitching 206.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e. methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods, and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions, and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements, and/or properties may be claimed through amendment of those claims or presentation of new claims in the present application or in a related application. Such amended or new claims, whether they are directed to the same example or a different example and whether they are different, broader, narrower, or equal in scope to the original claims, are to be considered within the subject matter of the examples described herein.

The invention claimed is:

1. An apparatus, comprising:

a rigid-flex core comprising a bendable strand of material, wherein the bendable strand of material:
- is bendable by hand from a first shape to a second shape; and
- approximately retains the second shape when released;

a woven textile cover surrounding the rigid-flex core, the woven textile cover comprising: a first length of woven textile, the first length in a range from six inches to ten feet;
- a second length of woven textile, the second length approximately the same as the first length;
- a first length-wise stitch that extends from a first end of the woven textile cover to a second end of the woven textile cover;
- a second length-wise stitch that extends from the first end of the woven textile cover to the second end of the woven textile cover;
- a center cavity having a volume that is greater than a volume of the rigid-flex core, wherein:
  - the center cavity is defined by:
  - the first length of woven textile along a top of the center cavity;
  - the second length of woven textile along a bottom of the center cavity; the first length-wise stitch along a first side of the center cavity; and the second length-wise stitch along a second side of the center cavity;
- the rigid-flex core is within the center cavity;
- the rigid-flex core is unrestrained within the center cavity such that the rigid-flex core is moveable within the center cavity along two degrees of freedom, the two degrees of freedom perpendicular to a length of the woven textile cover; and
- the rigid-flex core is adjacent to the first length of woven textile and the second length of woven textile;

a first flap along the first side of the center cavity, wherein:
- the first flap is formed by the first length of woven textile, the second length of woven textile, and the first length-wise stitch; and
- the first flap is opposite the first length-wise stitch from the center cavity; and a second flap along the second side of the center cavity, wherein:

the second flap is formed by the first length of woven textile, the second length of woven textile, and the second length-wise stitch; and the second flap is opposite the second length-wise stitch from the center cavity;

a first cap clamped onto the rigid-flex core and the woven textile cover at the first end of the woven textile cover; and a second cap clamped onto the rigid-flex core and the woven textile cover at the second end of the woven textile cover, wherein the first cap or the second cap prevents length-wise movement of the rigid-flex core relative to the woven textile cover.

2. The apparatus of claim 1, further comprising:

two of the bendable strand of material, wherein the two bendable strands of material are twisted together; or three or more of the bendable strand of material, wherein the three or more bendable strands of material are:

twisted together;

braided together; or otherwise intertwined together.

3. The apparatus of claim 1, the rigid-flex core further comprising a polymer sheath, wherein the polymer sheath:

is directly adjacent to the bendable strand of material such that the polymer sheath forms contact with a surface of the bendable strand of material; or the polymer sheath encases the bendable strand of material.

4. The apparatus of claim 1, the woven textile cover further comprising a single sheet of textile, wherein:

the single sheet of textile comprises a first edge and a second edge that extend from the first end of the woven textile cover to the second end of the woven textile cover;

the single sheet of textile is folded approximately in half length-wise to form the center cavity, wherein the first edge and the second edge are brought together;

the first flap is formed between the first length-wise stitch and the first and second edges of the single sheet of textile; and the second flap is formed between the second length-wise stitch and a length-wise fold in the single sheet of textile.

5. The apparatus of claim 1, the woven textile cover further comprising a top sheet of textile and a bottom sheet of textile, wherein:

the center cavity is formed between the top sheet of textile and the bottom sheet of textile; and the first length-wise stitch and the second length-wise stitch join the top sheet of textile and the bottom sheet of textile together.

6. The apparatus of claim 5, wherein:

a first edge of the top sheet of textile is stitched to a second edge of the bottom sheet of textile such that the first flap comprises a first joined strip;

a third edge of the top sheet of textile is stitched to a fourth edge of the bottom sheet of textile such that the second flap comprises a second joined strip;

the first edge of the top sheet of textile and the second edge of the bottom sheet of textile are unjoined such that the first flap comprises a first top strip and a first bottom strip; or the third edge of the top sheet of textile and the fourth edge of the bottom sheet of textile are unjoined such that the second flap comprises a second top strip and a second bottom strip.

7. The apparatus of claim 1, the woven textile cover further comprising a textile cap that extends around the first flap or the second flap along the length of the woven textile cover, wherein:

the textile cap extends from a top surface of the woven textile cover away from the center cavity and around an edge of the woven textile cover to a bottom surface of the woven textile cover; and the textile cap covers the first flap or the second flap.

8. The apparatus of claim 1, the woven textile cover further comprising a friction coating on an exterior surface of the woven textile cover, wherein:

the friction coating has a greater coefficient of friction than a textile material that forms the woven textile cover; and the friction coating is configured to resist slippage of the woven textile cover against itself as different sections of the woven textile cover are bound against each other.

* * * * *